US005255766A

United States Patent [19]

Deconinck

[11] Patent Number: 5,255,766

[45] Date of Patent: Oct. 26, 1993

[54] TRAVELLING OR PACKING BAG

[76] Inventor: Norbert D. H. Deconinck, 31 Boulevard du Commandant Charcot, F-92200 Neuilly-sur-Seine, France

[21] Appl. No.: 869,456

[22] Filed: Apr. 16, 1992

[30] Foreign Application Priority Data

Apr. 18, 1991 [FR] France ..... 91 04802

[51] Int. Cl.[5] ..... A45C 5/12

[52] U.S. Cl. ..... 190/36; 190/110; 206/292; 206/293

[58] Field of Search ..... 190/36, 110, 13 C; 206/292, 293, 298

[56] References Cited

U.S. PATENT DOCUMENTS

| | | | |
|---|---|---|---|
| 1,438,737 | 12/1922 | Witbeck | 190/36 |
| 1,725,116 | 8/1929 | Walker | 206/293 |
| 1,742,656 | 1/1930 | Laprade | 190/110 |
| 1,760,098 | 5/1930 | Wilt . | |
| 1,823,403 | 9/1931 | Krueger | 190/110 |
| 1,947,838 | 2/1934 | Piss | 206/292 |
| 2,001,806 | 5/1935 | Wheary . | |
| 2,138,202 | 11/1938 | Wilt | 206/292 |
| 2,362,807 | 11/1944 | Dresner | 206/292 |
| 2,422,511 | 6/1947 | Wolsey . | |
| 2,873,830 | 2/1959 | Wilt . | |
| 3,734,249 | 5/1973 | Wilt | 206/292 |

FOREIGN PATENT DOCUMENTS

| | | | |
|---|---|---|---|
| 709604 | 8/1931 | France | 190/110 |
| 756539 | 12/1933 | France . | |

*Primary Examiner*—Gary E. Elkins
*Attorney, Agent, or Firm*—Beveridge, DeGrandi, Weilacher & Young

[57] ABSTRACT

The bag enabling personal belongings to be packed and carried inside a case comprises a rigid inner tray (2) having a support edge (3) of rounded profile and a packing wall (4) which is at least partly solid. The tray (2) is pivotable between a horizontal position and a vertical position. Personal belongings (21, 22) can be laid flat on the packing wall when the tray (2) is in the horizontal position. In the vertical position a jacket previously folded in two in the longitudinal direction and a pair of trousers can be laid astride the edge (3).

35 Claims, 3 Drawing Sheets

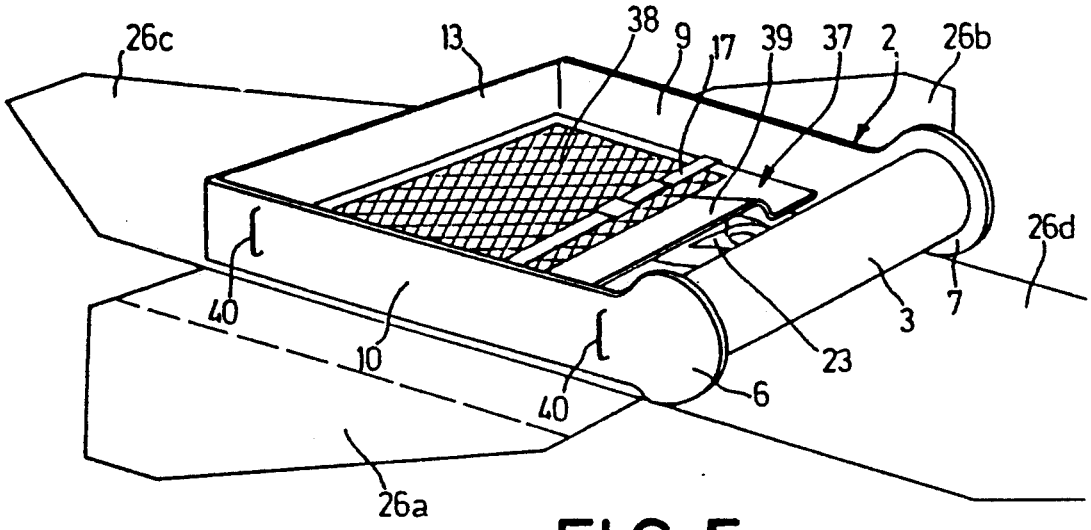
FIG. 5
FIG. 7
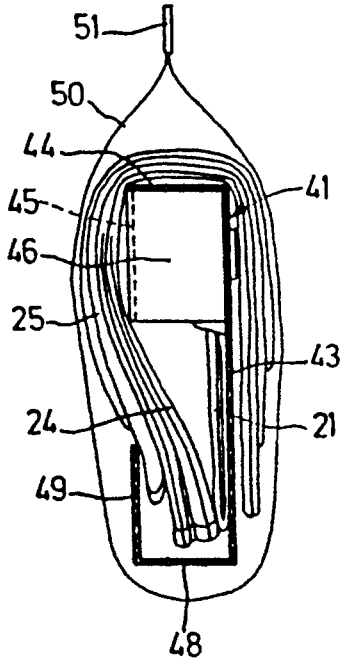
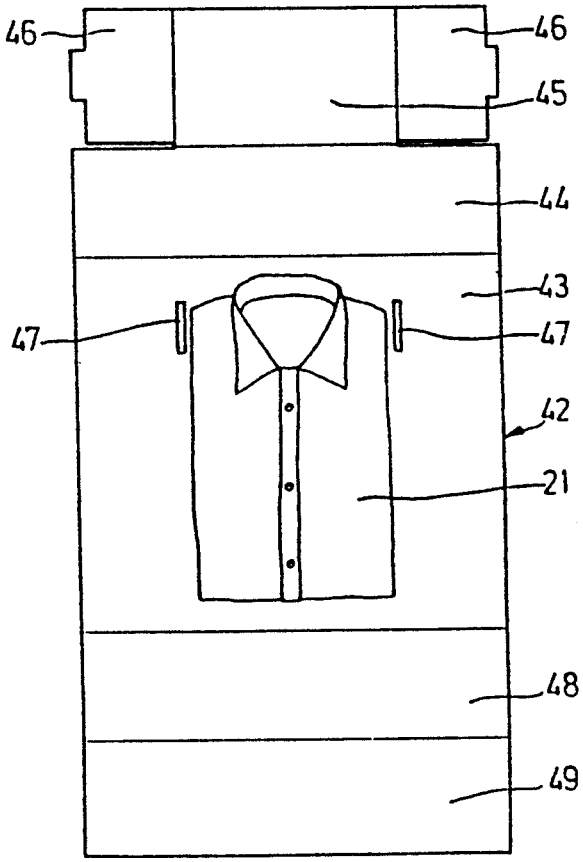
FIG. 6

TRAVELLING OR PACKING BAG

The present invention relates to a travelling bag arrangement which, in a more economical version, can also be used for packing garments in the retail trade.

This arrangement enables personal belongings to be packed and transported under optimum conditions in respect of positioning, protection and maintenance, inside a compact and easily handled container.

Various forms of luggage for carrying personal belongings are known.

Trunks provided with hangers and drawers enable numerous garments to be transported without crumpling them, but their weight and size make them unsuitable at the present time for modern transport means.

Suitcases which have a rigid shell and are fitted with a hanger and possibly an inner frame make it possible, provided that particular attention is given to the packing, to transport a suit or costume without crumpling them and without forming unwanted creases. However, these suitcases are bulky and in particular are not allowed in aircraft cabins.

Flexible bags of the hold-all type are of various sizes, some of which are allowed in the cabin, but belongings are piled in them without rigid protection, and it is impossible to carry certain garments therein without finding them crumpled on arrival.

Garment bags with a hanger obviate this disadvantage if they are always carefully carried and stored, but, as their width must as a minimum be equal to the shoulder width of a jacket, they are bulky, inconvenient to handle and therefore usually unattractive in appearance and not permissible in aircraft cabins.

From U.S. Pat. Nos. 2,001,806 (Wheary), 1,760,098 (Wilt) and 2,873,830 (Wilt) a bag is also known which comprises a device for attaching hangers and in which garments such as suits and trousers are folded transversely, for transport, over the rounded edge of an inside wall or of a removable plate, which increases the weight of the whole arrangement without contributing to the strength or structure of the baggage item. In addition, in the case of the U.S. Pat. Nos. 2,873,830 (Wilt) and 1,760,098 (Wilt) the rounded edge is directed downwards in order to facilitate the attachment of the hangers. However, the ends of the garments are then directed upwards and are held by the plate only within a determined thickness range and only if the bottom of the bag is rigid. With regard to the U.S. Pat. No. 2,001,806 (Wheary), the bag described therein does not unable the garments to be disposed easily around the rounded edge, nor does it permit easy packing of the inner compartment. Other personal belongings are packed in another compartment.

From French Patent 756 539 (Sarton) and U.S. Pat. No. 2,422,511 (Wolsey) rigid inserts are known with which it is intended to equip the interior of a suitcase and which have a rounded top edge to receive garments; such inserts are closed by side walls and may comprise inside compartments for hats, ties or small objects. However, the construction is such that packing of these compartments is very impractical.

None of these known baggage items is therefore entirely satisfactory for present-day travellers who want light luggage which is allowed in aircraft cabins (that is to say whose total outside dimensions are below 110 or 115 cm), which is easy to pack and to handle, and which enables them to carry, under the best conditions in respect of packing and protection, the personal belongings which are necessary for a short stay, and the said luggage should enable its user on arrival to have clothes still perfectly packed and uncrumpled.

In the retail clothing trade very similar problems are also found.

Before purchases are handed to a customer it is customary to fold clothing as well as possible and to clip it into a paper or plastics bag. If the customer has a journey to make or must wait some time before unpacking the clothes, they may become crumpled.

In order to overcome this disadvantage and to show the attentive service that they provide, some highclass retailers prefer to hand their customers their clothes (such as men's suits, ladies' suits, coats) hung on a hanger and packed in a cover similar to garment bags for travel. However, this cover is bulky and impractical for carrying, and this is intensified by the fact that it is unsuitable for packing shirts and other garments and that a customer who has bought a complete outfit will leave carrying several packages. In addition, this type of cover has the disadvantage of being suitable neither for gift wrapping nor for parcelling for despatch.

In this type of trade it would therefore be desirable to have available a packing making it possible to pack a suit, and possibly various other items, inside a container which is easy to handle, in such a manner that they can stay in it for some length of time, while the packing should in addition be utilisable for travelling or despatch without any risk of the garments being crumpled or losing their creases.

The present invention therefore has as its object to meet these various requirements and to counter the disadvantages mentioned above. It provides a travelling or packing bag ensuring easy packing and the transport under the best conditions of a certain number of personal belongings including at least one suit, the bag or packing being of slight width, particularly so that it can be accepted in the cabin in aircraft, and without it being necessary to provide hangers or other suspension devices.

According to the invention the travelling or packing bag for personal belongings comprises a flexible or rigid outer case or cover and clothes support means. The clothes support means comprise a rigid support edge disposed horizontally in the top part of the bag when the latter is in the transport position. The edge has a convex outside surface adapted to receive folded garments placed astride the support edge, and is adjacent to an opening delimited by a concave inside surface defining a crush protection zone for items, such as shirts, placed between the folded halves of the aforesaid garments.

It will be noted that the garments are thus perfectly supported by the rigid edge, without any other means, such as hangers or the like, being needed. The convex surface of the edge prevents the formation of undesirable creases. The concave inside surface provides perfect protection for shirt or blouse collars during transport.

The support edge may advantageously be bounded by an end edging defining an open part.

The rigid edge preferably forms part of a rigid inner tray provided with an at least partly solid packing wall which is opposite the aforesaid end edging and against which the personal belongings can be disposed. Such a rigid tray cooperates to the overall rigidity of the bag.

In one advantageous embodiment the rigid inner tray is adapted to be readily pivotable between a horizontal packing position enabling certain garments, such as shirts, pullovers, socks, pyjamas or personal belongings, to be laid flat on the packing wall, and a vertical transport position permitting the support, on the outside surface of the support edge, of garments such as jackets, trousers, skirts, or ties, laid in such a manner as to hang on each side of the packing wall, as previously indicated. These garments are thus enclosed an held between the rigid inner tray and the outer case when the latter is closed.

The support edge preferably extends entirely on the side of the inner face of the packing wall, so that the garments placed on the support edge come to bear on the outer face of the packing wall when the outer case is closed, so that they are protected against crumpling.

The support edge preferably has a width substantially equal to the half of a man's jacket or lady's suit, so that these garments can lie astride the support edge after having been folded in half lengthwise the jacket being folded along the sewing of the back so that, the two halves of the back the two flaps and the shoulders are superimposed. The height of the inner tray is preferably such that a jacket laid in this manner and resting at its middle on the support edge can hang on each side. It will thus be possible to lay on the support edge a pair of trousers and a jacket, or else a skirt and a lady's jacket, folded in half in the longitudinal direction. The overall thickness of the bag according to the invention may be of the order of 10 to 20 cm, and the three dimensions of the bag according to the invention can easily comply with the standards tolerated for luggage acceptable in aircraft cabins.

The support edge may be bounded on each side by projecting side rims, so that the garments supported by it will be effectively centred during transport and protected against excessive crushing. For the same reasons, the rims may advantageously be continued on the sides of the packing wall.

In a preferred embodiment a pivoted or free flap holds the personal belongings pressed flat against the packing wall; the flap may have a shell-shaped hood contributing to the protection of shirt collars.

A rim fastened to the packing wall is advantageously provided opposite the support edge, in such a manner as to hold personal belongings disposed on the packing wall when the rigid tray is placed in the vertical transport position. The assembly comprising the rims and the support edge, surrounding the packing wall, thus makes it possible to obtain for the rigid tray a shape similar to that of an open box, perfectly adapted to the packing of personal belongings on the inner face of the packing wall and to their subsequent transport under the best conditions.

The rigid inner tray may be provided with anchorage points for handles or carrying straps.

The rigid edge or the rigid inner tray may advantageously be made in one piece in a mouldable synthetic material. In another embodiment they may be made from a rigid or semi-rigid folded or formed sheet.

Means for securing personal effects laid flat on the packing wall are preferably provided, for example in the form of elastic or non-elastic straps, rigid or semi-rigid flaps, or any other equivalent means.

The packing surfaces, and also those of the securing means, may advantageously be treated with the aid of an elastomer coating or of a graining, a painting, a fabric or thin foam.

The outer case may comprise two rigid half-shells hinged directly to one another or to a base one of the half-shells or the base having a hinge means for the pivoting of the rigid inner tray. One of the half-shells constitutes a bottom and the other a lid, the rigid inner tray being pivotable inside them.

In an other embodiment the outer cover may comprise flexible or semi-rigid outer walls detachably fixed on the edges of the side flanks of the cover or of the rigid inner tray and surrounding the garments.

The cover may be made of leather, fabric or plastic materials. The closing may be effected by means of sliding or clasp fasteners, press-studs or bands, straps or laces allowing preferably a variation of the inner volume.

In a further embodiment, the outer case or cover may comprise flexible flaps hinged along the side flanks of the rigid inner tray and enclosing it like an envelope.

One or more carrying handles or a strap may in addition be provided for carrying the travelling bag of the invention. They may advantageously be supported or fixed directly on the rigid inner tray, thus reducing the stresses on the outer case.

In an application of the invention which is intended more particularly for the retail trade, the outer case is in the form of a flexible bag of plastics material or paper, inside which the rigid edge or the rigid inner tray can be housed. In this embodiment the inner tray or the rigid edge is preferably made of folded cardboard.

The invention will be better understood on study of the detailed description of some embodiments given as examples, which are in no way limitative, and illustrated in the accompanying drawings, in which:

FIG. 5 shows a variant of a rigid inner tray intended for equipping a travelling bag according to the invention;

FIG. 6 shows a variant of the invention, intended more particularly for packing clothing, before the sheet of cardboard intended to form the rigid inner tray has been folded, and FIG. 7 is a side view similar to FIG. 1 of the packing according to the invention, showing, inserted into a flexible case, the rigid cardboard inner tray shown in FIG. 6.

Figure 1:
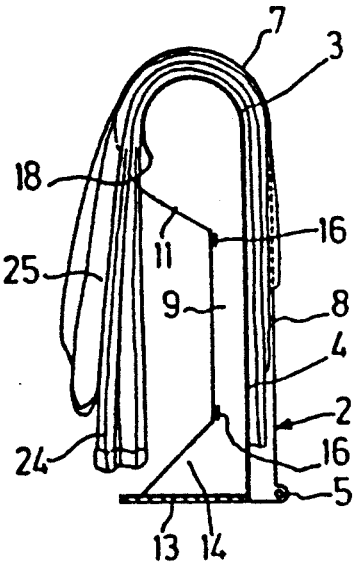
FIG. 1 is a side view, in section on the line I—I in FIG. 2 of a rigid inner tray provided in a travelling bag according to the invention.
Figure 2:
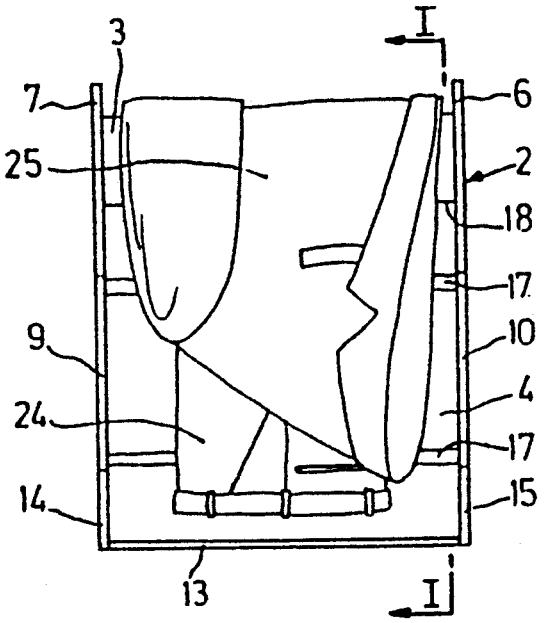
FIG. 2 is a front view of the tray shown in FIG. 1.
Figure 3:
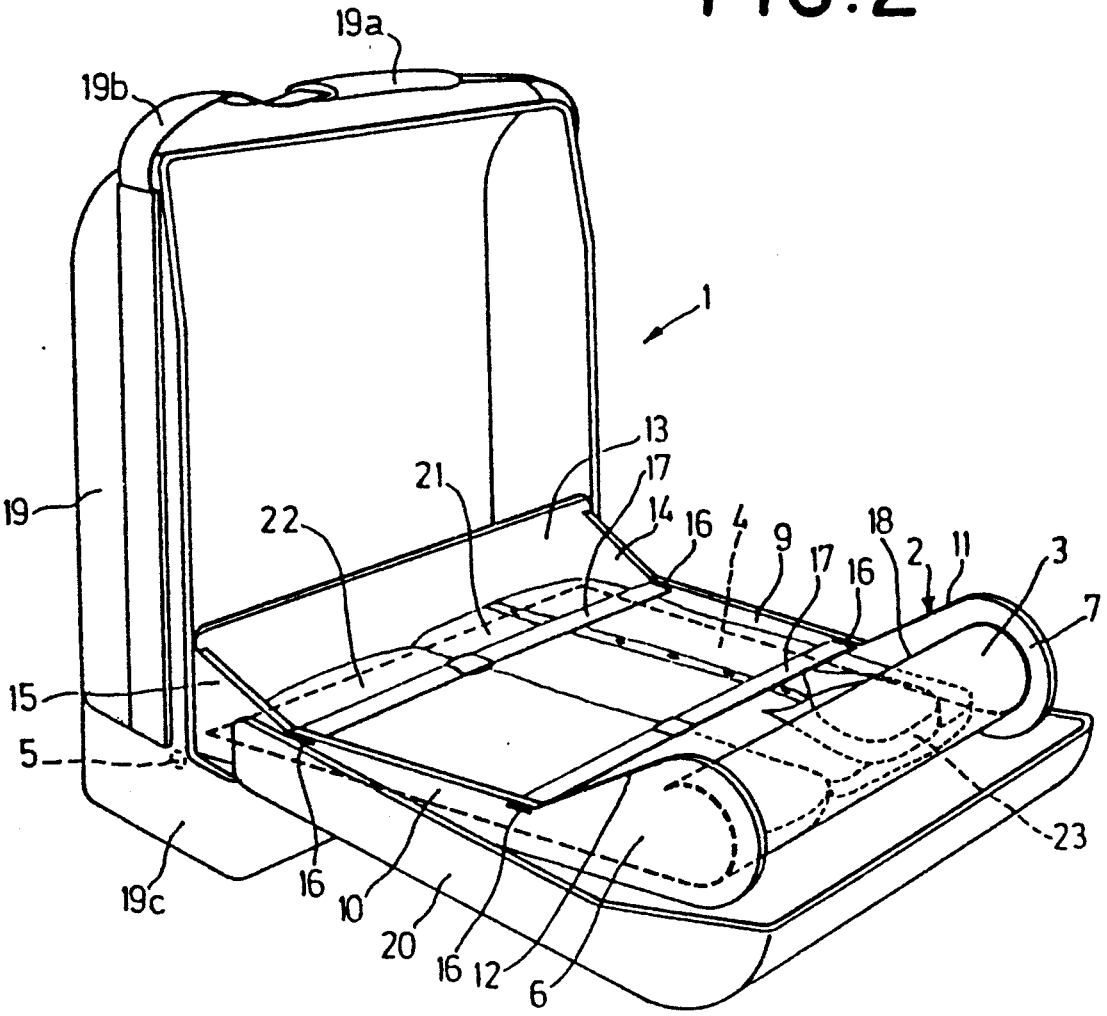
FIG. 3 illustrates the horizontal packing position of a rigid tray similar to that shown in FIGS. 1 and 2, mounted in a rigid outer case.

As illustrated in FIGS. 1 to 3, the travelling bag given the overall reference 1 and visible in FIG. 3 comprises a rigid inner tray given the overall reference 2 and made for example of moulded plastics material.

The rigid inner tray 2 has a support edge 3 of rounded profile with its convexity directed outwards, a packing wall 4, which is here shown in the form of a solid wall forming an extension of the edge 3 and occupying the entire height of the tray 2, as can be seen in FIGS. 1 and 2. In another embodiment the solid wall could be perforated in order to make it still lighter, or could even be replaced by a cloth. Finally, in another embodiment, only the edge 3 could be provided. On the edge of the packing wall 4 opposite the support edge 3 two recesses 5 are formed to constitute bearings, only one of which can be seen in FIG. 1 and which cooperate with pivot pins fastened to the rigid shell of the bag 1, said pins not being shown in the drawings.

Projecting rims 6, 7 surround the support edge 3 so as to bound it laterally, and are extended over the entire height of the tray 2 on each side of the packing wall 4. One of the rims 8 which is visible in FIG. 1 is thus in the bottom position when the tray 2 is placed in the horizontal packing position, as illustrated in FIG. 3, while the other rim 9 is above the packing wall 4, like the rim 10, in the same horizontal packing position of the tray 2. In the example illustrated the top rims 9, 10 are joined to the rims 6, 7 by an inclined portion 11, 12. A rim 13 opposite the support edge 3 lies at right angles to the packing wall 4, extending on each side of the latter as far as the rim 8. The rim 13 could have an extension parallel to the packing wall 4. The rims 9 and 10 are not as high as the rim 13 and are therefore connected to the said rim 13 by inclined portions 14, 15. Slots 16 formed in the side rims 9, 10 enable straps 17 to be fixed.

As can be noted in particular in FIG. 1, the support edge 3 is in the form of a hollow cylindrical tube. It has a convex outer surface over which garments can be laid, and a concave inner surface serving as a crush protection zone for the collars in particular of other garments. The edge has an end edging 18 and is therefore partly open in the direction of the opposite rim 13. The edging 18, which is slightly bent over inwards, enables the formation of marks on garments to be avoided. Together with the opposite rim 13 it bounds a wide opening enabling garments to be placed on the packing wall 4.

In the embodiment shown in FIG. 3 the travelling bag has an outer case comprising a half-shell 19 similar to a bottom and a half-shell 20 similar to a lid and hinged relative to the half-shell 19 in such a manner as to be able to open, as illustrated in FIG. 3, and to be reclosed for carrying; it is carried by means of a handle 19*a* fastened to the half-shell 19. The rigid or semi-rigid half-shells 19, 20 are for example made by moulding or forming a synthetic material or composite material, particularly one based on fibres, textiles or light forms. The handle 19*a* is defined by a strap 19*b* connected to the half-shell 19 by sliding inside a groove in such a manner that it can be fixed in various positions.

The rigid inner tray 2 is hinged above the bottom of the half-shell 19 with the aid of recesses 5, as can be seen in FIG. 3, thus leaving free a bottom compartment 19*c*, which can be used for additional packing, for example for shoes or soiled linen. This bottom compartment 19*c* may be moulded in suitable material separately from the half-shells.

The travelling bag illustrated in FIG. 3 can be used in the following manner. After the half-shell 20 has been opened and has assumed a horizontal position, while the half-shell 19 remains vertical, as shown in FIG. 3, the rigid inner tray 2 is placed in the horizontal position. In this position the inner face of the packing wall 4, around which extend the top rims 9 and 10 on the side faces, the bottom rim 13, and the support edge 3, constitutes a kind of box or container particularly suitable for packing personal belongings flat. As an example, FIG. 3 shows in light lines a shirt 21 laid flat on the inner face of the packing wall 4 and a pullover 22 likewise laid flat at the side of the shirt 21. It will be noted that the collar 23 of the shirt 21 is accommodated inside the support edge 3 and therefore perfectly protected during transport. The straps 17 press the shirt 21 and the pullover 22 against the inner face of the packing wall 4. Other personal belongings could of course be disposed on the packing wall 4.

This packing having been carried out, the long garments are laid on each side of the support edge 3, jackets first having been folded in two in the longitudinal direction, that is to say about the vertical median line of the back, the shoulders being laid one against the other. Trousers, if they are too long, are folded in two transversely, that is to say about a line at right angles to the leg seams.

The inner tray 2 is then placed in the vertical position as illustrated in FIGS. 1 and 2, the long garments being supported by the support edge 3 and hanging over the latter on each side. In this transport position the edge 3 is at the top part of the bag. It will be noted that in this vertical position of the rigid inner tray 2 the personal belongings previously disposed on the inner face of the packing wall 4 are perfectly held by the straps 17, which as a variant could also grip the long garments laid over the support edge 3. As an example, FIGS. 1 and 2 show the manner in which a pair of trousers 24 and a man's jacket 25 are disposed. They rest on the outer face of the packing wall 4, the opposite face to that against which the shirt 21 and pullover 22 lie.

When these operations have been completed, the half-shell 20 is closed.

The width of the tray 2 corresponds substantially to that of the jacket 25 after it has been folded in two in the longitudinal direction. The height of the tray 2 is such as to make it possible to place the trousers 24 and jacket 25, folded in two, over the support edge 3 in the manner described above. The height is also sufficient to accommodate the shirts 21 and pullovers 22 on the inner face of the packing wall 4, as previously indicated. It is obviously also possible for other garments, such as a skirt, woman's suit, raincoat, and the like, to be laid astride the support edge 3. Given a slightly increased thickness of the bag, more than one suit can also be disposed on the edge 3, and the shoulders can be laid in a staggered arrangement.

The dimensions of the rigid inner tray 2 remain slight, thus limiting the overall size of the travelling bag 1 according to the invention. As an example, an overall height of the bag 1 of the order of 45 cm, an overall width of the order of 45 cm, and an overall thickness of the order of 15 cm could be adopted.

In an embodiment which makes use only of the edge 3, without the tray 2, the clothes 21, 22 can simply be accommodated between the parts of the garments 24, 25 hanging on each side of the support edge 3 and held between the walls of the outer case, the collars of the shirts being perfectly protected by the concave inside surface of the support edge 3.

Figure 4:
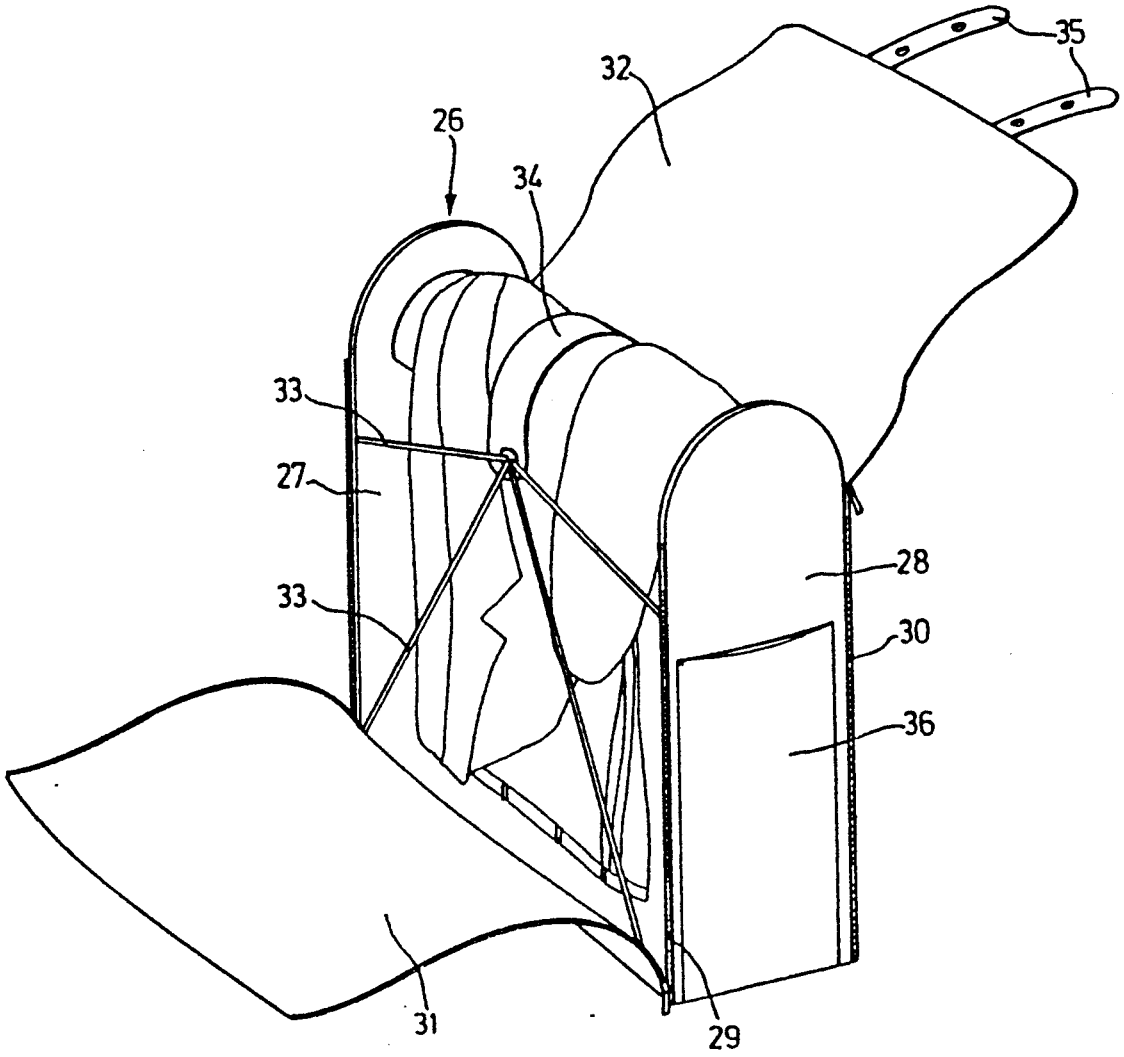
FIG. 4 shows the vertical transport position of a rigid inner tray mounted inside a flexible outer case.

In the embodiment illustrated in FIG. 4 the outer case has flexible walls surrounding a rigid inner tray 26, which has a structure practically identical to that of the inner tray 2 in the preceding embodiment, the only difference being the shape of the end walls 27, 28, which here form the side faces of the travelling bag of the invention, and which may advantageously be covered in fabric or the like. The straight edges of the side faces 27, 28 are provided with sliding clasp elements 29, 30, with the aid of which the flexible walls 31 and 32 can be opened and closed. The sliding clasp fasteners 29, 30 extend as far as the top rounded rims of the end side walls 27, 28. Elastic ties 33 cooperate with a strap 34 to hold against the rigid inner tray 26 the garments which are folded in it, these garments being illustrated here in the form of a jacket and a pair of trousers, as in the preceding embodiment.

For the utilisation of this embodiment the rigid inner tray 26 is once again placed in the horizontal position, the fasteners 29 and 30 being open in order to enable personal belongings to be disposed on the inner face of the packing wall of the said tray 26 in the same circumstances as in the previous embodiment. The fasteners 29 then preferably being closed, the tray can be pivoted into the vertical position, as previously, and the fasteners 30 can be closed and the flap 32 also closed with the aid of the attachments 35. It is also possible first to place the tray 26 in the vertical position, as illustrated in FIG. 4, and then to lay the folded garments over the edge of the tray 26 before fastening the ends of the ties 33 in a loop on the strap 34, as illustrated in FIG. 4. The two sliding clasp fasteners 29, 30 can then be closed, and the flexible wall 32 folded over and fixed on the flexible wall 31, for example by means or straps 35. A handle fastened to the wall 32 enables the traveling bag to be carried in the vertical position illustrated in FIG. 4.

Additional pockets, such as the outside pocket 36, may also be provided on the outside faces of the bag. A small pocket of the document case type may be inserted between the clothes and the flexible wall of the outer case.

In this embodiment also it would be perfectly possible to dispense with the packing wall of the rigid inner tray 26 and to provide only a rigid edge.

In that case, the long garment is first laid flat. The rigid edge is then placed transversely. The inner garments are then disposed directly in the concavity of the rigid edge delimiting a suitable opening and on the adjacent part of the long garments. The other part of the long garment is finally folded around the rigid edge and over the inner garments.

In the embodiment illustrated in FIG. 5, where the inner tray 2 is shown and in which similar components carry the same references, the tray can be wrapped in an outer case comprising envelope-like flaps 26*a* to 26*d*. The shirts laid on the inner face of the packing wall are held by a flap 37 which covers them and has a semi-rigid surface ventilated by a net 38. On the side near the support edge 3 the flap 37 has a hood in the form of a rigid shell 39, which surrounds and protects the shirt collars 23, cooperating with the support edge 3. The hood 39 may be replaced by a simple cutout of appropriate shape in the flap 37. The flap 37 is held under appropriate pressure by a strap 17.

The rims 9, 10 are provided with bows 40 for fastening a carrier strap for the bag and allowing variation of the inner volume.

The embodiment illustrated in FIGS. 6 and 7 is particularly interesting for the solution of the problems of packing clothes, particularly in the retail trade. In the embodiment the rigid inner tray 41 is made with the aid of a folded sheet of corrugated cardboard. FIG. 6 illustrates the said sheet of corrugated cardboard, which is given the general reference 42 and is shown flat before the utilisation of the packing. A central portion 43 serves as packing wall and enables one or more shirts 21 or pullovers or other similar garments to be placed on it. A fold line defines a zone 44 forming the support edge for long garments such as the trousers 24 and the jacket 25 which can be seen in FIG. 7. The support edge 44 is extended by a flap 45 provided with lateral fastening tabs 46, which cooperate with slots 47 formed in the packing wall 43 when the sheet is folded to form the support edge, as can be seen in FIG. 7.

At the opposite end to the support edge 44 a zone 48 is formed, likewise by fold lines, to produce an end rim provided with a flap 49, which takes up position parallel to the packing wall 43, as can be seen in FIG. 7.

After the shirts 21 or similar garments have been placed on the inner face of the packing wall 43, as illustrated in FIG. 6, the rigid inner tray 41 visible in side view in FIG. 7 is formed by folding. Long garments, such as the trousers 24 and jacket 25, can then be placed on the support edge 44, as previously explained for the embodiments of the traveling bag of the invention which are illustrated in FIGS. 1 to 5. In the embodiment shown in FIGS. 6 and 7 it will be noted that the long garments 24, 25 are in addition held by the flap 49 which closes the bottom part of the rigid inner tray 41.

The whole arrangement, brought back to the vertical position as shown in FIG. 7, can then easily be inserted into a flexible bag 50 of paper or plastics material, which is provided with a holding handle 51.

The invention thus provides a rapid and practical means for packing personal belongings and clothes, enabling them to be transported in a light, compact form minimising crumpling.

I claim:

1. A travelling bag for personal belongings including garments such as trousers, skirts and at least a jacket and other clothes such as shirts with collars, comprising:

an outer case having a top part and adapted to be carried in a vertical transport position;

a rigid inner tray having a packing wall which is at least partly solid and has a rigid hollow support edge disposed along one side thereof;

said support edge having a convex surface adapted to receive said garments laying astride the support edge;

said rigid inner tray being adapted to be readily pivotable between a horizontal packing position enabling clothes to be laid flat on the packing wall partly inside said hollow support edge, and a vertical transport position in which said rigid support edge is disposed horizontally in said top part of said outer case;

said rigid inner tray being provided with a securing means for securing clothes laid flat on said packing wall, said securing means including a flap having protection means for protecting collars of shirts from being crushed.

2. A travelling bag according to claim 1 wherein the packing wall has an inner face and an outer face, and the support edge extends entirely along one side of the packing wall, said case being closed, said travelling bag including garments and personal belongings which bear on the outer face of said packing wall.

3. A travelling bag according to claim 1 in combination with a jacket which is folded in half lengthwise along the median line of its back with its shoulders and two halves of its back being superposed, said folded jacket having a folded width and an overall length, said support edge having a width substantially equal to the folded width of said jacket, said inner tray having a height substantially equal to one-half the overall length of said jacket, said jacket being positioned outside the support edge.

4. A travelling bag according to claim 1 having projecting rims which laterally bound the support edge.

5. A travelling bag according to claim 1 wherein the packing wall has two faces, and rims which laterally bound at least one of said faces.

6. A travelling bag according to claim 1 wherein the rigid inner tray has an edge which is opposite from said rigid support edge, and a rim is fastened to said opposite edge.

7. A travelling bag according to claim 1 wherein the outer case includes two half shells which are hinged together, one of said half shells having a hinge which pivotally supports the rigid inner tray.

8. A travelling bag for personal belongings including garments such as trousers, skirts and at least a jacket and other clothes such as shirts with collars comprising:

an outer case having a top part, said outer case being adapted to be carried in a vertical transport position;

a rigid inner tray having lateral edges, a packing wall which is at least partly solid, and a rigid hollow support edge disposed along one side thereof;

said support edge having a convex surface adapted to receive said garments laying astride the support edge, said rigid inner tray being adapted to be movable between a horizontal packing position enabling said clothes to be laid flat on the packing all partly inside said hollow support edge and a vertical transport position in which said rigid support edge is disposed horizontally in said top part of said outer case;

said outer case having flexible outer walls which are detachably secured to said lateral edges of the rigid inner tray.

9. A travelling bag according to claim 8 wherein the packing wall has an inner face and an outer face, and the support edge extends entirely along one side of the packing wall, said case being closed, said travelling bag including garments and personal belongings which bear on the outer face of said packing wall.

10. A travelling bag according to claim 8 in combination with a jacket which is folded in half lengthwise along the median line of its back with its shoulders and two halves of its back being superposed, said folded jacket having a folded width and an overall length, said support edge having a width substantially equal to the folded width of said jacket, said inner tray having a height substantially equal to one-half the overall length of said jacket, said jacket being positioned outside the support edge.

11. A travelling bag according to claim 8 having projecting rims which laterally bound the support edge.

12. A travelling bag according to claim 8 wherein the packing wall has two faces, and rims which laterally bound at least one of said faces.

13. A travelling bag according to claim 8 having securing means for securing personal belongings to the rigid inner tray.

14. A travelling bag according to claim 8 in which said securing means includes a flap which has protection means for protecting shirt collars from being crushed.

15. An assembly for transporting personal belongings including garments such as trousers, skirts and at least a jacket and other clothes such as shirts with collars comprising:

a flexible outer case having a top part and adapted to be carried in a vertical transport position, said flexible outer case being a flexible bag;

a rigid tray having a packing wall which is at least partly solid and has a rigid hollow support edge disposed along one side thereof;

said support edge having a convex surface adapted to receive said garments laying astride the support edge, said rigid inner tray being adapted to be placed in a horizontal packing position enabling said clothes to be laid flat on the packing wall partly inside said hollow support edge and in a vertical transport position in which said rigid support edge is disposed horizontally.

and a flexible bag adapted for housing said rigid tray.

16. A travelling bag according to claim 15 wherein the packing wall has an inner face and an outer face, and the support edge extends entirely along one side of the packing wall, said travelling bag including garments and personal belongings which bear on the outer face of said packing wall.

17. A travelling bag according to claim 15 in combination with a jacket which is folded in half lengthwise along the median line of its back with its shoulders and two halves of its back being superposed, said folded jacket having a folded width and an overall length, said support edge having a width substantially equal to the folded width of said jacket, said inner tray having a height substantially equal to one-half the overall length of said jacket, said jacket being positioned outside the support edge.

18. A travelling bag according to claim 15 wherein the rigid inner tray has an edge which is opposite from said rigid support edge, and a rim is fastened to said opposite edge.

19. A travelling bag for personal belongings including garments such as trousers, skirts and at least a jacket and other clothes such as shirts with collars comprising:

an outer case having a top part and adapted to be carried in a vertical transport position;

a rigid inner tray having a packing wall which is at least partly solid and has a rigid hollow support edge disposed along one side thereof;

said support edge having a convex surface adapted to receive said garments laying astride the support edge;

said rigid tray being adapted to be readily pivotable between a horizontal packing position enabling said clothes to be laid flat on the packing wall partly inside said hollow support edge and a vertical transport position in which said rigid support edge is disposed horizontally in said top part of said outer case;

a jacket folded lengthwise and having its shoulders and two halves of its back in superposition, said rigid inner tray having an overall width sufficient to receive a maximum width of said jacket folded lengthwise so that said jacket with the shoulders and the two halves of the back in superposition is supported only by said support edge in said vertical transport position.

20. A travelling bag according to claim 19 wherein the packing wall has an inner face and an outer face, and the support edge extends entirely along one side of the packing wall, said case being closed, said travelling bag including garments and personal belongings which bear on the outer face of said packing wall.

21. A travelling bag according to claim 19 having projecting rims which laterally bound the support edge.

22. A travelling bag according to claim 19 wherein the packing wall has two faces, and rims which laterally bound at least one of said faces.

23. A travelling bag according to claim 19 wherein the rigid inner tray has an edge which is opposite from said rigid support edge, and a rim is fastened to said opposite edge.

24. A travelling bag according to claim 19 having means for securing personal belongings to the rigid inner tray.

25. A travelling bag according to claim 24 in which said securing means includes a flap which has protection means for protecting shirt collars from being crushed.

26. A travelling bag according to claim 19 wherein said tray is provided with anchorage points which are connectible to a carrying member for carrying the bag.

27. A travelling bag according to claim 19 wherein the outer case includes two half shells which are hinged together, one of said half shells having a hinge which pivotally supports the rigid inner tray.

28. A travelling bag for personal belongings including garments such as trousers, skirts and at least a jacket and other clothes such as shirts with collars, comprising:

an outer case having a top part and adapted to be carried in a vertical transport position;

a rigid inner tray having a packing wall which is at least partly solid and has a rigid hollow support edge disposed along one side thereof, said support edge having a convex surface adapted to receive said garments laying astride the support edge;

said rigid inner tray being adapted to be readily pivotable between a horizontal packing position enabling said clothes to be laid flat on the packing wall partly inside said hollow support edge and a vertical transport position in which said rigid support edge is disposed horizontally in said top part of said outer case, and garments which are fully supported in said vertical transport position by said support edge of said tray without any additional hanging means.

29. A travelling bag according to claim 28 in which one of said garments is a jacket which is folded in half lengthwise along the median line of its back with its shoulders and two halves of its back being superposed, said folded jacket having a folded width and an overall length, said support edge having a width substantially equal to the folded width of said jacket, said inner tray having a height substantially equal to one-half the overall length of said jacket, said jacket being positioned outside the support edge.

30. A travelling bag according to claim 28 having projecting rims which laterally bound the support edge.

31. A travelling bag according to claim 28 wherein the packing wall has two faces, and rims which laterally bound at least one of said faces.

32. A travelling bag according to claim 28 wherein the rigid inner tray has an edge which is opposite from said rigid support edge, and a rim is fastened to said opposite edge.

33. A travelling bag according to claim 28 having means for securing personal belongings to the rigid inner tray.

34. A travelling bag according to claim 28 in which said securing means includes a flap which has protection means for protecting shirt collars from being crushed.

35. A travelling bag according to claim 28 wherein the outer case includes two half shells which are hinged together, one of said half shells having a hinge which pivotally supports the rigid inner tray.

* * * * *